US007644690B2

(12) United States Patent
Yoshika et al.

(10) Patent No.: US 7,644,690 B2
(45) Date of Patent: Jan. 12, 2010

(54) ARRANGEMENT STRUCTURE OF ELECTRICALLY-DRIVEN ACTUATOR

(75) Inventors: Daisuke Yoshika, Okazaki (JP); Shinichi Murata, Okazaki (JP); Hitoshi Toda, Okazaki (JP); Masashi Igarashi, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 98 days.

(21) Appl. No.: 11/978,571

(22) Filed: Oct. 30, 2007

(65) Prior Publication Data

US 2008/0099707 A1 May 1, 2008

(30) Foreign Application Priority Data

Oct. 31, 2006 (JP) ..... 2006-297045

(51) Int. Cl.
*F01L 1/34* (2006.01)

(52) U.S. Cl. ..... 123/90.16; 123/90.15

(58) Field of Classification Search ..... 123/90.15, 123/90.16, 90.31
See application file for complete search history.

(56) References Cited

U.S. PATENT DOCUMENTS 6,523,512 B2 * 2/2003 Axmacher et al. ..... 123/90.17

FOREIGN PATENT DOCUMENTS

| | | | |
|---|---|---|---|
| JP | 2001-107739 | A | 4/2001 |
| JP | 2004-332549 | A | 11/2004 |
| JP | 2005-207255 | A | 8/2005 |
| JP | 2005-299536 | A | 10/2005 |
| JP | 2006-242014 | A | 9/2006 |

* cited by examiner

*Primary Examiner*—Zelalem Eshete
(74) *Attorney, Agent, or Firm*—Birch, Stewart, Kolasch & Birch, LLP

(57) ABSTRACT

An arrangement structure of an electrically-driven actuator is used in a variable valve operating mechanism capable of adjusting an operation of a valve of an engine. A part of the electrically driven actuator exposed to the outside of the engine is arranged at a position shifted in a car width direction with respect to an exothermic body provided at a periphery of the engine.

12 Claims, 10 Drawing Sheets

ARRANGEMENT STRUCTURE OF ELECTRICALLY-DRIVEN ACTUATOR

CROSS-REFERENCE TO RELATED APPLICATIONS

This application is based upon and claims the benefit of priority from prior Japanese Patent Application No. 2006-297045, filed Oct. 31, 2006, the entire contents of which are incorporated herein by reference.

BACKGROUND OF THE INVENTION

1. Field of the Invention

The present invention relates to an arrangement structure of an electrically-driven actuator used in a variable valve operating mechanism in which an operation of at least one of an intake valve and an exhaust valve of an engine can be adjusted.

2. Description of the Related Art

Many valve operating mechanisms of engines mounted on automobiles are constituted such that a valve opening/closing timing or a valve opening period of an intake valve or an exhaust valve can be adjusted from the viewpoint of exhaust gas measures or the like.

As an example of a structure of the variable valve operating mechanism, a structure is proposed in which a displacement of a cam provided on a camshaft is transferred to an oscillating cam of a reciprocating type by using a center rocker arm, and an intake valve or an exhaust valve is driven by a rocker arm driven by the oscillating cam. The oscillating cam has a shape in which a base circle section and a lift section are continuous with each other.

The posture of the center rocker arm is adjusted by the actuator. When the posture of the center rocker arm is changed, a position at which the center rocker arm is in contact with the cam is changed and a position at which the center rocker arm is in contact with the oscillating cam is also changed. As a result, the operation of the intake valve or the exhaust valve is changed. A variable valve operating mechanism of this type is disclosed in, for example, Jpn. Pat. Appln. KOKAI Publication No. 2005-299536.

An electrically-driven actuator represented by an electric motor is employed as the actuator. An actuator of this type is disclosed in Jpn. Pat. Appln. KOKAI Publication No. 2004-332549.

It is desirable that an electrically-driven actuator of a variable valve operating mechanism be accommodated in a cylinder head cover in order to make the engine compact.

However, the above-mentioned valve operating mechanism is accommodated in the cylinder head cover, and hence it is difficult to accommodate the electrically-driven actuator in the cylinder head cover. Thus, a part or an entire part of the electrically-driven actuator is exposed to the outside of the cylinder head cover in some cases.

On the other hand, when an automobile is moving, heat generated from the engine, heat generated from the transmission, and heat generated from the radiator core is cooled by a wind caused by an air blast of a fan or movement of the car.

When the engine is stopped, the wind caused by the air blast of the fan or the movement of the car disappears. As a result, after the engine is stopped, the heat generated from the engine, the heat generated from the transmission, and the heat generated from the radiator core stagnates in the engine room. In the engine room, a flow path of the heat is generated. Specifically, the flow path is a flow path of heat in which the stagnating heat, i.e., the heated air first moves to an upper part in the engine room, and then moves toward the rear part of the car body along the slant of the hood member. In this case, if the part of the electrically-driven actuator exposed to the outside of the engine is arranged in the flow path of heat, the motor is heated by the heat. When the motor is heated, the coil resistance inside the motor is increased or the magnet is demagnetized. As a result, the performance of the motor is lowered and the control response is deteriorated.

If the control response is deteriorated, the effect of the variable valve operating mechanism is deteriorated, and hence it is undesirable that the motor is heated.

Thus, the capacity of the motor is set large in some cases. However, if the motor capacity is increased, the mountability of the actuator is deteriorated by an increase in the motor size. Further, the cost of the motor is increased due to the need to enhance the performance of the magnet used in the motor. Further, by heating the motor, the lubricity of the grease inside the motor is deteriorated, and hence the durability of the motor is also deteriorated in some cases.

BRIEF SUMMARY OF THE INVENTION

An object of the present invention is to provide an arrangement structure of an electrically-driven actuator capable of restraining an electrically-driven actuator from being heated.

An arrangement structure of an electrically-driven actuator of the present invention is an arrangement structure of an electrically-driven actuator to be used in a variable valve operating mechanism capable of adjusting an operation of a valve of an engine. A part of the electrically-driven actuator exposed to the outside of the engine is arranged at a position shifted in a car width direction with respect to an exothermic body provided at a periphery of the engine.

According to this configuration, the part of the electrically-driven actuator exposed to the outside of the engine is hardly exposed to heat flowing in an engine room.

In a desirable aspect of the present invention, the exothermic body is a transmission. The part of the electrically-driven actuator exposed to the outside of the engine is positioned on the opposite side of the transmission on the engine.

According to this configuration, the part of the electrically-driven actuator exposed to the outside of the engine is hardly exposed to heat generated from the transmission.

In a desirable aspect of the present invention, the exothermic body is a radiator core. When the engine is arranged in the engine room, the part of the electrically-driven actuator exposed to the outside of the engine is arranged on a side surface of the engine at a position at which the actuator does not overlap the radiator core in a back-and-forth direction of a car body.

According to this configuration, the part of the electrically-driven actuator exposed to the outside of the engine is hardly exposed to heat generated from the radiator core.

In a desirable aspect of the present invention, the part of the electrically-driven actuator exposed to the outside of the engine is positioned above the engine auxiliary machinery when the engine is arranged in the engine room.

According to this configuration, a flow of heat flowing upwardly is blocked by the engine auxiliary machinery. As a result, the part of the electrically-driven actuator exposed to the outside of the engine is hardly exposed to the heat.

In a desirable aspect of the present invention, the part of the electrically-driven actuator exposed to the outside of the engine is positioned, when the engine is arranged in an engine room, above an engine bracket used to attach the engine to a part in the engine room.

According to this configuration, a flow of heat flowing upwardly is blocked by the engine bracket. As a result, the part of the electrically-driven actuator exposed to the outside of the engine is hardly exposed to the heat.

In a desirable aspect of the present invention, the engine is provided with a transfer mechanism for transferring the rotation of a crankshaft to a camshaft. At least a part of the electrically-driven actuator is arranged in a space in which the transfer mechanism is accommodated in the engine.

According to this configuration, a part of the electrically-driven actuator is arranged in a space in which the transfer mechanism is accommodated, whereby the engine is prevented from becoming large in size. Furthermore, when the transfer mechanism is a chain, a reduction gear mechanism provided between the electrically-driven actuator and the variable valve operating mechanism is lubricated by oil spattered by the driving of the chain, thereby obtaining effects of improving durability and reducing friction.

In a desirable aspect of the present invention, the engine is provided with an intake manifold and an exhaust manifold. The electrically-driven actuator is arranged separate from the intake manifold and the exhaust manifold in a crankshaft axial direction. Further, the exothermic body is the intake manifold and the exhaust manifold.

According to this configuration, the part of the electrically-driven actuator exposed to the outside of the engine is hardly exposed to heat generated from the intake manifold and the exhaust manifold. Moreover, the part of the electrically-driven actuator exposed to the outside of the engine does not interfere with the intake manifold or the exhaust manifold, and hence the maintenance such as replacement of the electrically-driven actuator is facilitated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
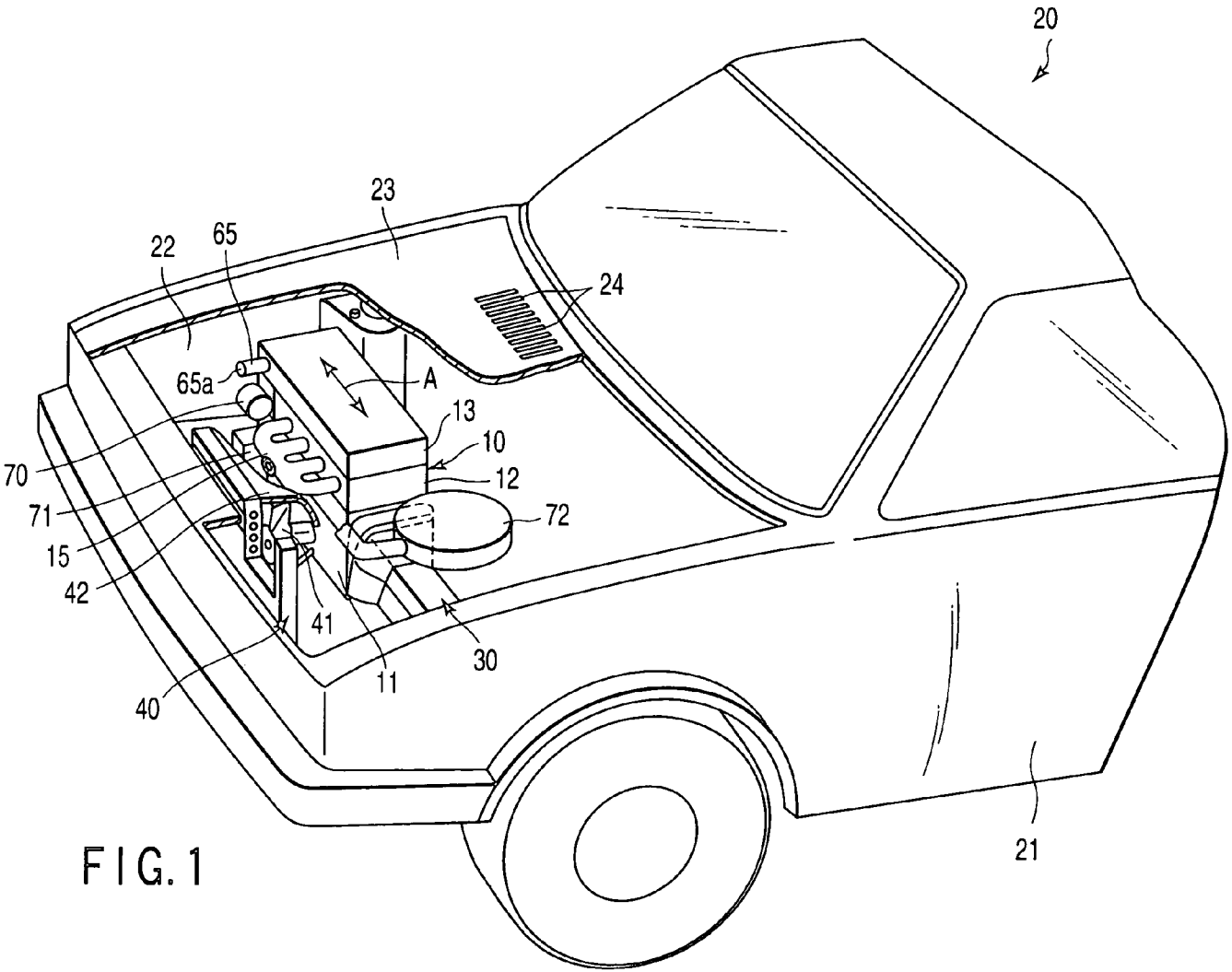
FIG. 1 is a perspective view showing an engine room of an automobile equipped with an engine provided with an arrangement structure of an electrically-driven actuator according to a first embodiment of the present invention.

An arrangement structure of an electrically-driven actuator according to a first embodiment of the present invention will be described below with reference to FIGS. 1 to 7. FIG. 1 is a perspective view showing an engine room 22 of an automobile 20. An engine provided with the arrangement structure of an electrically-driven actuator of the present invention is accommodated in the engine room 22.

As shown in FIG. 1, in a car body 21 of the automobile 20, the engine room 22 is formed at a front part thereof. The engine room 22 is covered with an openable hood member 23. A plurality of slits 24 are formed at a rear part of the hood member 23. The inside and the outside of the engine room 22 communicate with each other through the slits 24. Incidentally, in FIG. 1, the hood member 23 is shown in a state where it is partially cut out.

An engine 10, engine auxiliary machinery, a transmission 30 (an example of an exothermic body), a radiator core 40 (an example of an exothermic body), a fan 41, and the like are arranged in the engine room 22.

Figure 2:
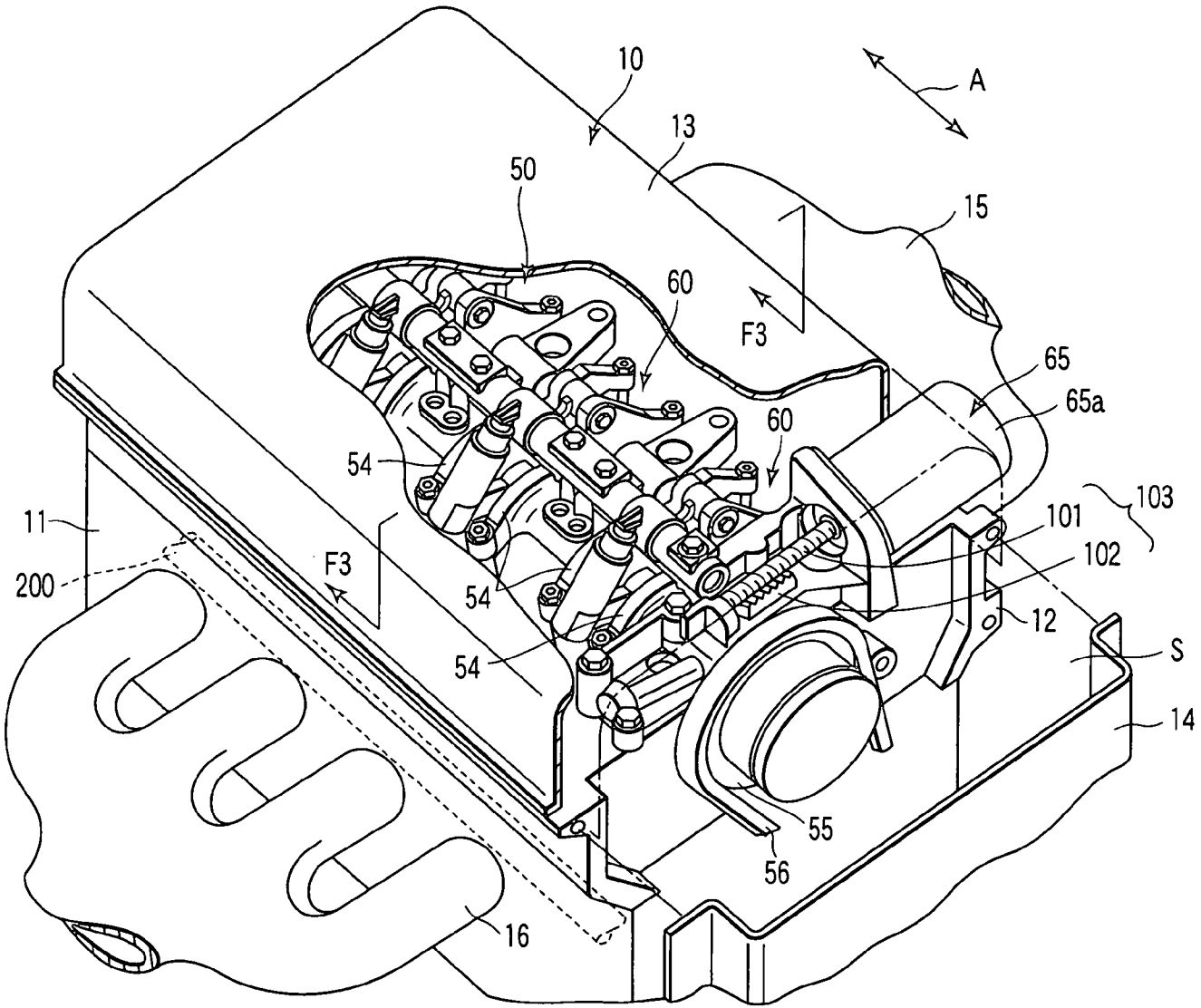
FIG. 2 is a perspective view showing an interior of the engine shown in FIG. 1.

The engine 10 is, for example, a reciprocating engine in which a plurality of cylinders are arranged in a straight line. FIG. 2 is a perspective view showing an interior of the engine 10. As shown in FIGS. 1 and 2, the engine 10 comprises a cylinder block 11, a cylinder head 12, a cylinder head cover 13, a chain cover 14, an intake manifold 15, and an exhaust manifold 16.

Figure 3:
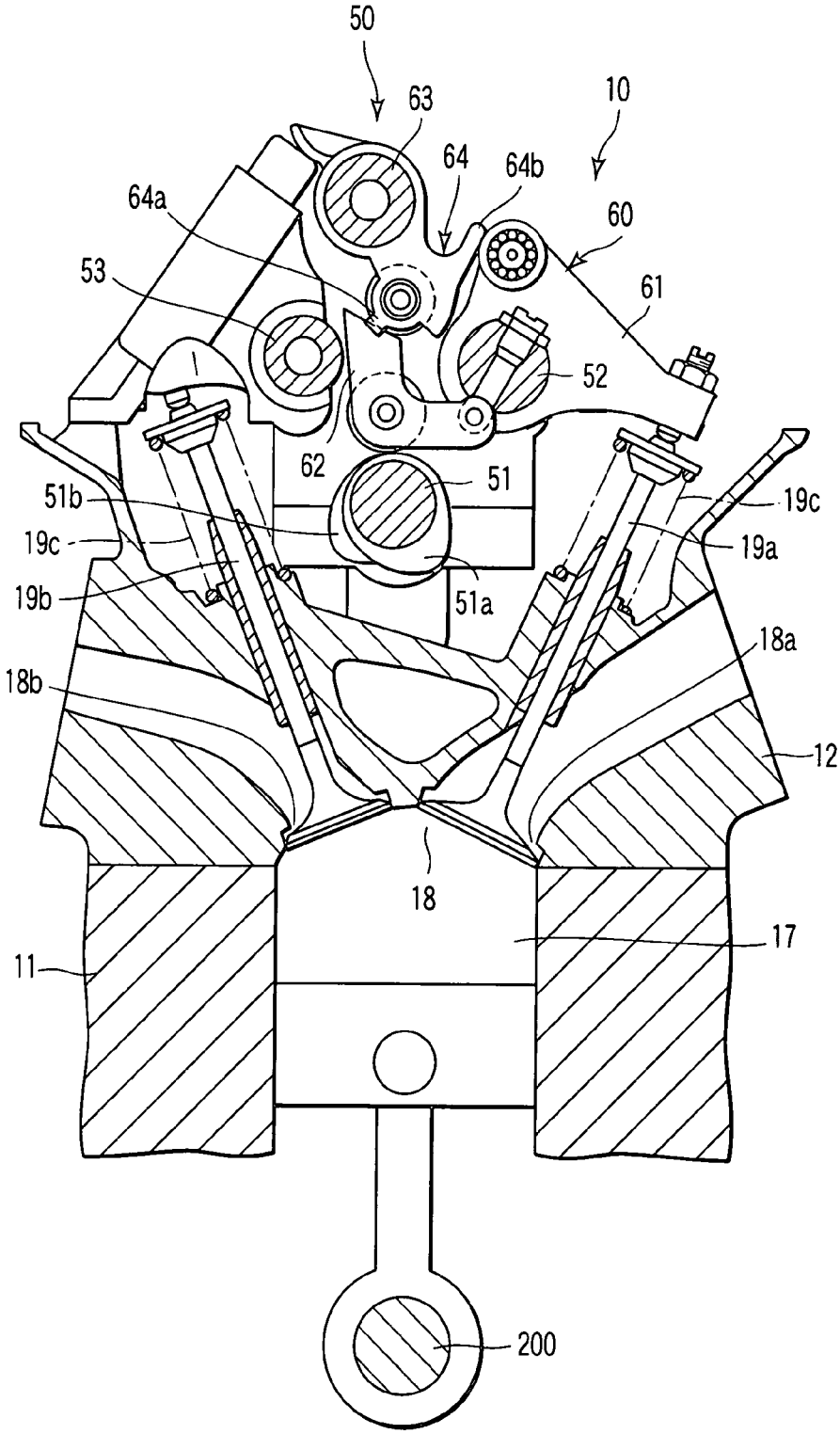
FIG. 3 is a cross-sectional view of the engine taken along line F3-F3 shown in FIG. 2.

FIG. 3 is a cross-sectional view of the engine 10 taken along line F3-F3 shown in FIG. 2. As shown in FIG. 3, combustion chambers 18 are formed in the cylinder head 12 so as to correspond to cylinders 17 formed in the cylinder block 11. In the combustion chamber 18, for example, a pair of intake ports 18*a* and a pair of exhaust ports 18*b* are formed. Further, an intake valve 19*a* for opening/closing each intake port 18*a* and an exhaust valve 19*b* for opening/closing each exhaust port 18*b* are provided in the cylinder head 12. Each of the intake valve 19*a* and exhaust valve 19*b* is of the normally-closed type energized by a spring 19*c* in a direction in which it is closed.

A variable valve operating mechanism 50 is mounted on the side of the cylinder head 12 opposite to the cylinder block 11. The variable valve operating mechanism 50 has a function of adjusting the opening/closing operation of the intake valve 19*a* or the exhaust valve 19*b*. In this embodiment, the variable valve operating mechanism 50 has a function of adjusting the opening/closing operation of, for example, the intake valve 19*a*.

The variable valve operating mechanism 50 includes a camshaft 51, an intake valve rocker shaft 52, an exhaust valve rocker shaft 53, an exhaust valve rocker arm 54 (partly shown in FIG. 2), and a rocker arm mechanism 60.

The camshaft 51 is arranged at a position opposed to the combustion chamber 18. The camshaft 51 extends in a direction A in which the cylinders are arrayed as shown in FIG. 2, and is supported so as to be rotatable around the axis line of the camshaft 51. A cam sprocket 55 is attached to a distal end of the camshaft 51. The cam sprocket 55 is coupled to a crank sprocket (not shown) attached to an end of a crankshaft 200 through a timing chain 56. As a result of this, rotation of the crankshaft 200 is transferred to the camshaft 51 through the timing chain 56, whereby the camshaft 51 is driven. The crankshaft 200 extends in the direction A in which the cylinders are arranged. Thus, the crankshaft 200 is parallel to the camshaft 51. The crankshaft axis extends in the direction A. The crankshaft 200 is indicated with a dotted line in FIG. 2.

The cam sprocket 55 and the timing chain 56 are arranged outside the cylinder block 11 and the cylinder head 12. The cam sprocket 55 and the timing chain 56 constitute a so-called transfer mechanism in the present invention.

As shown in FIG. 3, the camshaft 51 is provided with an intake valve cam 51*a* and an exhaust valve cam 51*b*. The intake valve cam 51*a* is cam for driving the intake valve 19*a*. The exhaust valve cam 51*b* is a cam for driving the exhaust valve 19*b*.

The intake valve rocker shaft 52 is arranged at a position closer to the intake valve 19*a* side than the camshaft 51. The intake valve rocker shaft 52 extends in parallel with the camshaft 51, and is supported so as to be rotatable around the axis line of the rocker shaft 52. The exhaust valve rocker shaft 53 is arranged on the opposite side of the intake valve rocker shaft 52. The exhaust valve rocker shaft 53 extends in parallel with the camshaft 51, and is supported so as not to be rotatable. The exhaust valve rocker arm 54 is provided on the exhaust valve rocker shaft 53. The exhaust valve rocker arm 54 is driven by the exhaust valve cam 51*b*, and drives the exhaust valve 19*b*.

Figure 4:
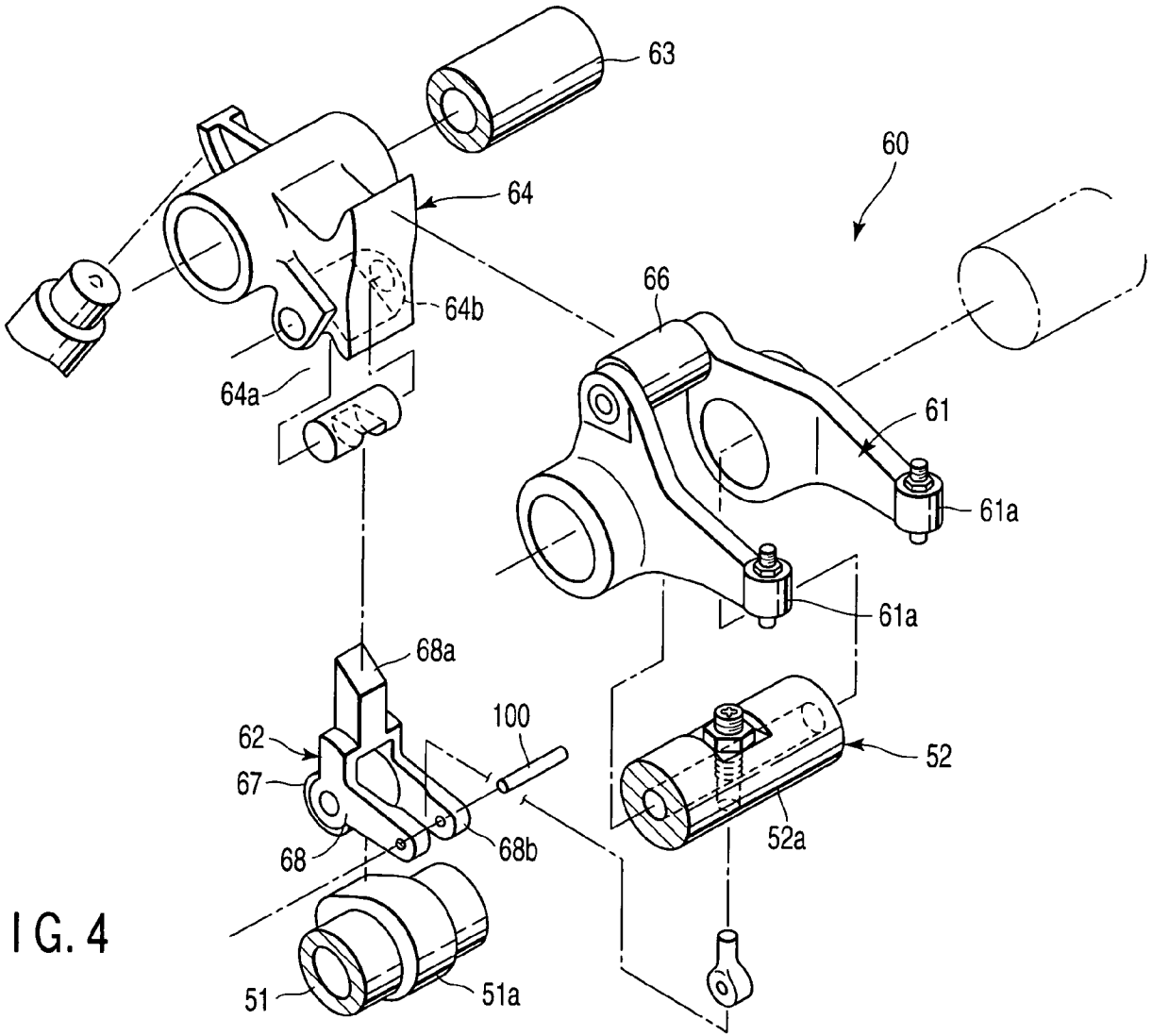
FIG. 4 is a perspective view showing a state where the rocker arm mechanism shown in FIG. 3 is disassembled.

The rocker arm mechanism 60 is driven by the intake valve cam 51*a*. FIG. 4 is a perspective view showing a state where the rocker arm mechanism 60 is disassembled. As shown in FIG. 4, the rocker arm mechanism 60 is provided with an intake valve rocker arm 61, a center rocker arm 62, a support shaft 63, a swing cam 64, and an electric motor 65 (shown in FIG. 2).

The intake valve rocker arm 61 is swingably supported on the intake valve rocker shaft 52. The intake valve rocker arm 61 is provided with a pair of rocker arm pieces 61*a* for transferring a displacement of a cam lift of the intake valve cam 51*a* to each intake valve 19*a*. These rocker arm pieces 61*a* are arranged side by side along the intake valve rocker shaft 52, and are swingably supported on the intake valve rocker shaft 52, and hence the intake valve rocker arm 61 has a bifurcate shape. Accordingly, a part 52*a* of the intake valve rocker shaft 52 is exposed between the rocker arm pieces 61*a*. A roller member 66 to be in contact with the swing cam 64, to be described later, is disposed between the rocker arm pieces 61*a*.

The center rocker arm 62 is provided with a point-contact piece 67 to be in point contact with the intake valve cam 51*a*, and a holder section 68 for supporting the point-contact piece 67. The holder section 68 includes a relaying arm section 68*a* extending toward the opposite side of the cylinder block 11, and a fulcrum arm section 68*b* extending toward the part 52*a* exposed between the rocker arm pieces 61*a*, and is formed into a substantially L-shape.

The fulcrum arm section 68*b* is swingably supported on the exposed part 52*a* by means of, for example, a pin 100 or the like. Accordingly, when the intake valve rocker shaft 52 is rotated, the posture of the center rocker arm 62 is changed with this rotation. When the point-contact piece 67 receives a displacement of the cam lift of the intake valve cam 51*a*, whereby the position of the distal end of the relaying arm section 68*a* is changed.

As shown in FIG. 3, the support shaft 63 is arranged at a position farther from the cylinder block 11 than the intake valve rocker shaft 52 and the exhaust valve rocker shaft 53.

The swing cam 64 is swingably supported by the support shaft 63. The swing cam 64 includes a displacement receiving section 64*a* to be in contact with the distal end of the relaying arm section 68*a* of the center rocker arm 62, and an arm section 64*b* to be in contact with the roller member 66 of the rocker arm 61. When the displacement receiving section 64*a* receives a displacement of the center rocker arm 62, the swing cam 64 is swung around the support shaft 63. At this time, the arm section 64*b* pushes the roller member 66.

The electric motor 65 is an example of the so-called electrically-driven actuator in the present invention. As shown in FIG. 2, the electric motor 65 is coupled to a reduction gear mechanism, and the reduction gear mechanism is constituted of a worm gear 103 made up of a worm wheel 102 attached to an end of the intake valve rocker shaft 52 and a worm attached to a shaft of the electric motor. The arrangement structure of the electric motor 65 will be described later in detail.

The electric motor 65 rotates the intake valve rocker shaft 52 through the worm gear 103. When the electric motor 65 rotates the intake valve rocker shaft 52, a position of the support section supporting the fulcrum arm section 68*b* of the center rocker arm 62 is changed on the intake valve rocker shaft 52. With this change, the posture of the center rocker arm 62 is changed.

When the posture of the center rocker arm 62 is changed, a degree of the displacement of the cam lift caused by the intake valve cam 51*a* to be transferred to the swing cam 64 is changed. As a result of this, the swing of the swing cam 64 is changed, and hence the operation of the rocker arm 61 is also changed. In this way, by adjusting the posture of the intake valve rocker shaft 52 by means of the electric motor 65, the operation of the intake valve 19*a* is adjusted.

Incidentally, the structure of the variable valve operating mechanism 50 having the configuration described above is only an example and the structure is not limited to the configuration described above. The variable valve operating mechanism 50 may be constituted in such a manner that the mechanism 50 is provided with, for example, an electrically-driven actuator, and can adjust the operation of at least one of the intake valve 19*a* and the exhaust valve 19*b* by means of the other configuration.

The cylinder head cover 13 is attached to the cylinder head 12 so as to cover the variable valve operating mechanism 50. The cylinder head cover 13 has such a size that a part of the cam sprocket 55 and a part of the timing chain 56 can be covered.

The chain cover 14 is attached to the cylinder head 12 and the cylinder block 11 so as to cover the part of the cam sprocket 55 and the part of the timing chain 56 which are not covered with the cylinder head cover 13. In other words, the cam sprocket 55 and the timing chain 56 are covered with both the cylinder head cover 13 and the chain cover 14.

The intake manifold 15 is attached to a part of the cylinder head 12 on one of the sides parallel to the direction A in which the cylinders 17 are arrayed. The exhaust manifold 16 is attached to a part on the opposite side of the intake manifold. As shown in FIG. 1, the transmission 30 is attached to one of ends of the engine 10 in the direction in which the cylinders 17 are arrayed.

Figure 5:
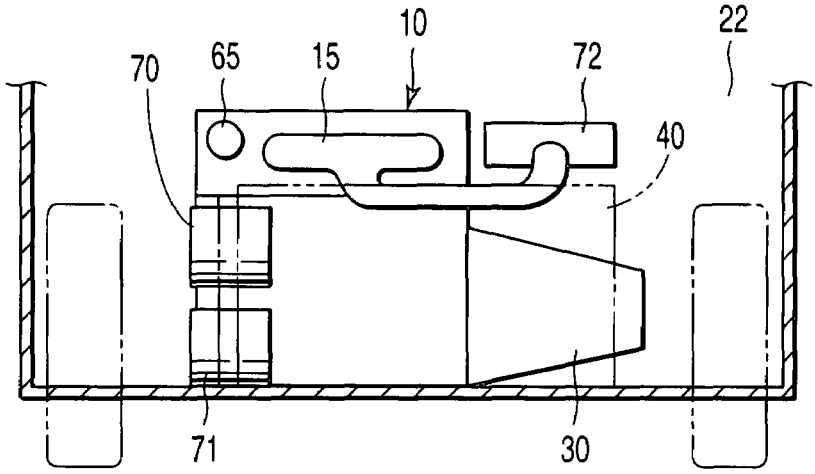
FIG. 5 is a front view schematically showing the interior of the engine room in which the engine provided with the arrangement structure of the electrically-driven actuator according to the first embodiment of the present invention is arranged as viewed from the front of the car body.

FIG. 5 is a front view schematically showing the interior of the engine room 22 in which the engine 10 is arranged as viewed from the front of the car body. As shown in FIG. 5, an alternator 70, an air conditioner compressor 71, an air cleaner 72, and the like are attached to the engine 10 as examples of engine auxiliary machinery. The alternator 70 is coupled to a crank pulley of the crankshaft 200 through a V-belt (not shown), and hence the alternator 70 is arranged on one of end sides of the crankshaft 200 of the engine 10 opposite to the transmission 30 in this embodiment.

More specifically, the alternator 70 is arranged on one of end sides of the crankshaft 200 of the engine 10 opposite to the transmission 30 at a position on the side surface directed to the front in the back-and-forth direction of the car body. The air conditioner compressor 71 is coupled to the crankshaft 200 through a V-belt (not shown), and thus when the engine 10 is arranged in the engine room 22, the compressor 71 is arranged below the alternator 70.

The air cleaner 72 is arranged above the transmission 30 when the engine 10 is arranged in the engine room 22. In the engine room 22, it is relatively easy to secure an accommodation space above the transmission 30. The air cleaner 72 is arranged in this accommodation space.

Figure 6:
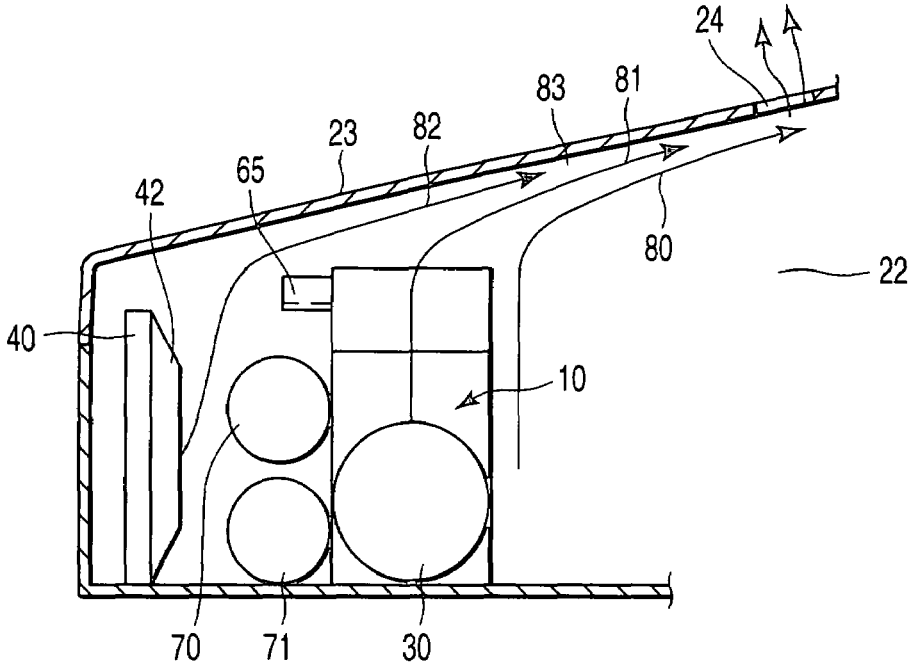
FIG. 6 is a side view schematically showing the interior of the engine room in which the engine provided with the arrangement structure of the electrically-driven actuator according to the first embodiment of the present invention is arranged as viewed from a lateral position in the car width direction.

FIG. 6 is a side view schematically showing the interior of the engine room 22 in which the engine 10 is accommodated in the width direction of the car. As shown in FIGS. 1, 5, and 6, the radiator core 40 is arranged at the front part of the engine room 22. Incidentally, in FIG. 5, the radiator core 40 is indicated by a two-dot chain line. The radiator core 40 extends in the car width direction, and a part thereof overlaps a part of the engine 10 in the back-and-forth direction of the car body 21.

As shown in FIG. 1, the fan 41 is arranged at the back of the radiator core 40 in the engine room 22. The fan 41 is covered with a fan shroud 42. In FIG. 1, the radiator core 40 and the fan shroud 42 are shown partially cut out.

As shown in FIG. 6, a flow path 83 is formed along which heat produced by a confluence of heat 80 generated from the engine 10, heat 81 generated from the transmission 30, and heat 82 generated from the radiator core 40 flows toward the rear part of the car body along the inclination of the hood member 23. The heat 80 to 82 is discharged to the outside of the engine room 22 through the slits 24 formed in the hood member 23.

Next, the arrangement structure of the electric motor 65 will be described below. As shown in FIGS. 1 and 5, the electric motor 65 is arranged at a position of the engine 10 on the opposite side of the transmission 30 deviated from the transmission 30 in the car width direction, i.e., on the side of the engine 10 on which the cam sprocket 55 and the timing chain 56 are arranged, and is arranged at a position avoiding interference with the intake manifold 15 and the exhaust manifold 16. In detail, the electric motor 65 is located separate from the intake manifold 15 and the exhaust manifold 16 in the crankshaft axial direction (the direction A).

Further, the electric motor 65 is protruded from the cylinder head cover 13 to the outside in such a manner that when the engine 10 is arranged in the engine room 22, the motor 65 is located above the alternator 70 and overlaps the alternator 70 in the vertical direction.

Figure 7:
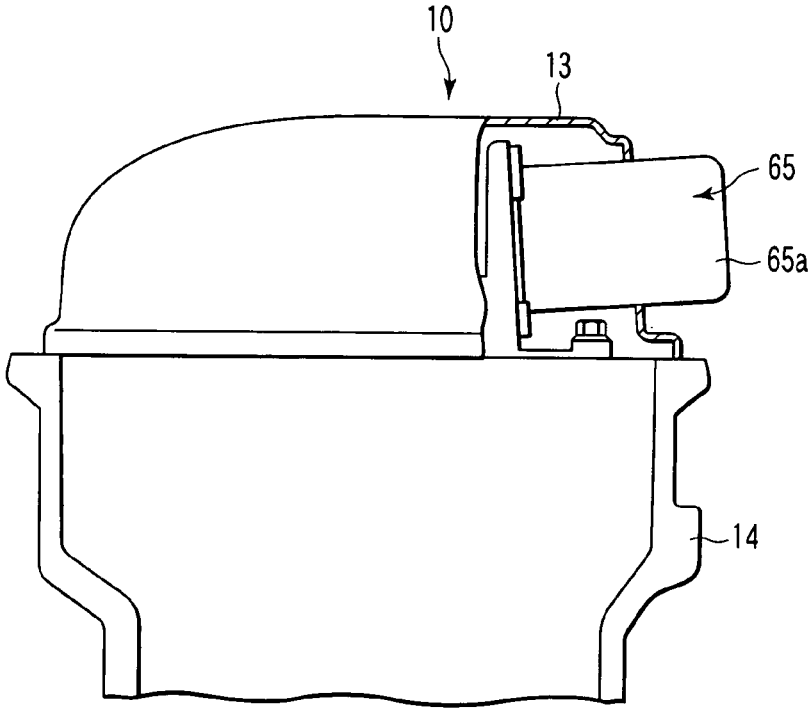
FIG. 7 is a front view showing an end part of the side on which the actuator is arranged in the engine shown in FIG. 2.

FIG. 7 is a front view showing the end part of the engine 10 on the side on which the electric motor 65 is arranged. As shown in FIGS. 2 and 7, a part of the electric motor 65 is accommodated in the cylinder head cover 13. As described above, the electric motor 65 has a performance, i.e., a size sufficient to rotate the intake valve rocker shaft 52 when the operation of the intake valve 19*a* is to be adjusted. However, as described above, the variable valve operating mechanism 50 is accommodated in the cylinder head cover 13.

Therefore, at least a part of the electric motor 65 is protruded outside from the end of the cylinder head cover 13 toward the front of the car body. However, the electric motor 65 is located at a position apart from the heat 81 ascending from the transmission 30, and hence the motor 65 is hardly affected by the heat 81. Furthermore, the electric motor 65 can be protected from the heat 80 ascending from the engine to the upper part of the engine room 22 by the alternator 70, and thus the motor 65 is hardly subjected to the heat 80.

Moreover, the electric motor 65 is arranged at a position along the axis line of the camshaft 51 outside the cylinder arranged at a position closest to the cam pulley 55 along the axis line of the camshaft 51, and a part of the motor 65 makes an inroad into a transfer mechanism accommodation space S which is defined by the cylinder head cover 13 and the chain cover 14 and in which the cam pulley 55 and the timing chain 56 are accommodated. For this reason, the electric motor 65 does not extend outside the cylinder head cover 13 in the direction A in which the cylinders 17 are arranged.

Furthermore, as shown in FIG. 5, the electric motor 65 is arranged at a position on the engine 10 shifted to one side in the car width direction with respect to the radiator core 40 when the engine 10 is arranged in the engine room 22, the position being a position on the side surface of the engine 10 at which the motor 65 does not overlap the radiator core 40 in the back-and-forth direction of the car body 21.

Accordingly, the electric motor 65 is arranged at a position at which the motor 65 does not overlap the radiator core 40 in the back-and-forth direction of the car body 21, and hence even if, for example, the distance between the radiator core 40 and the electric motor 65 is small in the back-and-forth direction of the car body, the motor 65 is arranged at a position at which the motor 65 can avoid the heat 82 ascending from the radiator core 40 to the upper position engine room 22, and flowing toward the rear part of the car body along the inclination of the hood member 23. Further, the electric motor 65 is positioned at the back of the radiator core 40 in the back-and-forth direction of the car body, i.e., on the downstream side of the flow path 83. Thus, there is the possibility of the electric motor 65 being exposed to the heat 82 when the heat 82 that has descended to the upper part of the engine room 22 flows toward the rear part of the car body. However, the electric motor 65 is arranged on the side surface of the engine 10, and hence even if the heat 82 that has ascended to the upper part of the engine room 22 flows toward the rear part of the car body with diffusing, the heat 82 hardly strikes the motor 65.

Next, the function of the arrangement structure of the electric motor 65 will be described below. When the automobile 20 is in the moving state, the fan 41 is driven. When the automobile 20 is in the moving state, the radiator core 40, the engine 10, and the transmission 30 are cooled by the wind produced by the blast of the fan 41 and the movement of the automobile 20.

When the engine 10 is stopped and the automobile 20 is stopped, the fan is also stopped, and hence the blast of the fan 41 is stopped and the wind produced by the movement of the automobile 20 disappears. For this reason, as shown in FIG. 6, from immediately after the engine 10 is stopped, the heat 82 in the radiator core 40 flows upwardly. Likewise, the heat 80 in the engine 10, and the heat 81 in the transmission 30 flows upwardly.

As described above, the heat 80 to 82 ascends to the upper part of the engine room 22, and forms a flow path 83 along which the heat flows along the inclination of the hood member toward the rear part of the car body, and the heat is guided to the slits 24 formed in the hood member 23. The heat 80 to 82 guided to the slits is discharged to the outside through the slits 24.

In the arrangement structure of the electric motor 65 constituted in this way, the electric motor 65 is arranged at a position at which the motor 65 is hardly subjected to the heat 80 to 82, and hence the motor 65 can be prevented from being subjected to the heat produced by the confluence of the heat 80 from the engine 10, the heat 82 from the radiator core 40, and the heat 81 from the transmission 30. Therefore, the electric motor 65 is prevented from being heated after the engine 10 is stopped.

The electric motor 65 is prevented from being heated, and hence a high variable response of the electric motor 65 can be obtained. Further, the motor capacity need not be set large, and hence it is possible to suppress a deterioration in the mountability of the electric motor caused by an increase in the motor size, and suppress a rise in the cost caused by an improvement in the property of the magnet used in the motor. Furthermore, it is possible to control the deterioration in durability of the motor caused by heat.

Further, when the engine 10 is arranged in the engine room 22, the electric motor 65 is arranged above the auxiliary machinery of the engine 10, i.e., in this embodiment, the alternator 70 and the air conditioner compressor 71. For this reason, when not only the heat 80 from the engine 10 but also the heat 81 from the transmission 30 and the heat 82 from the radiator core 40 flows upwardly, the heat components 81 and 82 directed to the electric motor 65 strike the alternator 70 and the air conditioner compressor 71, whereby the heat components are blocked, and hence the electric motor 65 is hardly subjected to the heat. Accordingly, the electric motor 65 is hardly heated.

Further, the electric motor 65 is arranged on the opposite side of the transmission 30 on the engine 10, and hence relatively large units or devices such as the air cleaner 72 are arranged on the transmission 30 side in the engine room 22, whereby the electric motor 65 is prevented from interfering with the air cleaner 72 and the like.

Further, the electric motor 65 is arranged in such a manner that a part of the motor 65 overlaps the transfer mechanism in a direction perpendicular to the crankshaft axial direction in the transfer mechanism accommodation space S defined by the cylinder head cover 13 and the chain cover 14, thereby making it possible to prevent the total length of the engine 10 from becoming large.

Furthermore, the worm gear 103 provided between the electrically-driven actuator and the variable valve operating mechanism is lubricated by oil spattered by the driving of the timing chain 56, thereby obtaining effects of improving durability and reducing friction.

Moreover, because the electric motor 65 is arranged at an end part of the engine 10, the electric motor 65 hardly interferes with the intake manifold 15 and the exhaust manifold 16, and the electric motor 65 is hardly subjected to heat. As a result, the electric motor 65 is hardly heated. Furthermore, maintenance such as replacement of the electric motor 65 is facilitated.

Next, an arrangement structure of an electrically-driven actuator according to a second embodiment of the present invention will be described below by taking an electric motor 65 as an example with reference to FIG. 8. Incidentally, a configuration having the same function as the first embodiment is denoted by the same reference symbols as those in the first embodiment and a description thereof is omitted.

This embodiment differs from the first embodiment in the position at which the electric motor is arranged. The other structures may be identical to those of the first embodiment. The above-mentioned different point will be specifically described below.

Figure 8:
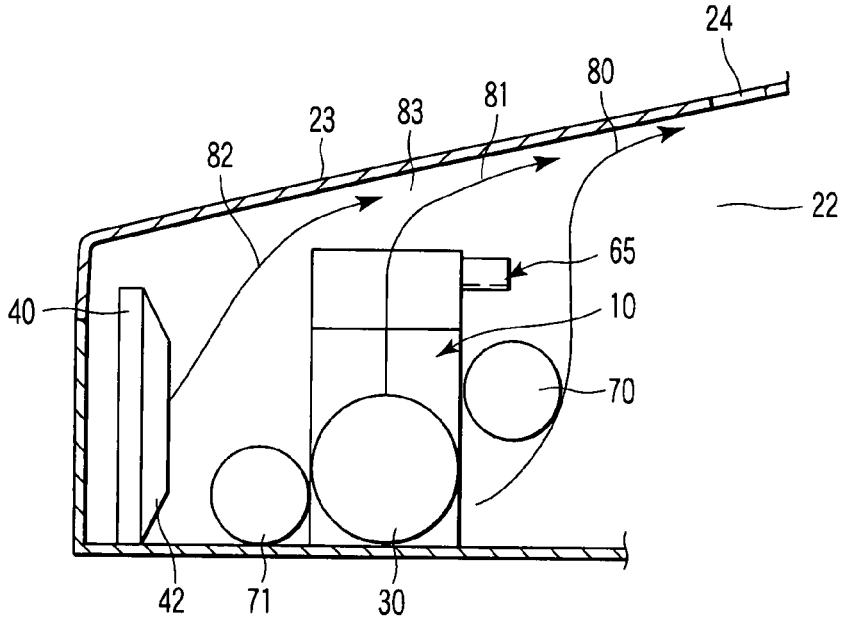
FIG. 8 is a side view schematically showing the interior of an engine room in which an engine provided with an arrangement structure of an electrically-driven actuator according to a second embodiment of the present invention is arranged as viewed from a lateral position in the car width direction.

FIG. 8 is a side view schematically showing an interior of an engine room 22 in which an engine according to this embodiment is arranged in a car width direction. As shown in FIG. 8, in this embodiment, for example, an alternator 70, which is an example of engine auxiliary machinery, is arranged on a side surface of an engine 10 on the chain-cover 14 side at the back of the engine 10 when the engine 10 is arranged in the engine room 22. The electric motor 65 is arranged above the alternator 70.

As in this embodiment, by arranging engine auxiliary machinery below the electric motor 65, even when the electric motor 65 is arranged on the surface of the engine 10 facing the rear part of the car body, the same advantage as in the first embodiment can be obtained.

Next, an arrangement structure of an electrically-driven actuator according to a third embodiment of the present invention will be described below by taking an electric motor 65 as an example with reference to FIG. 9. Incidentally, a configuration having the same function as the first embodiment is denoted by the same reference symbols as those in the fist embodiment and a description thereof is omitted.

This embodiment differs from the first embodiment in the position at which the electric motor is arranged. The other structures may be identical to those in the first embodiment. The above-mentioned different point will be specifically described below.

Figure 9:
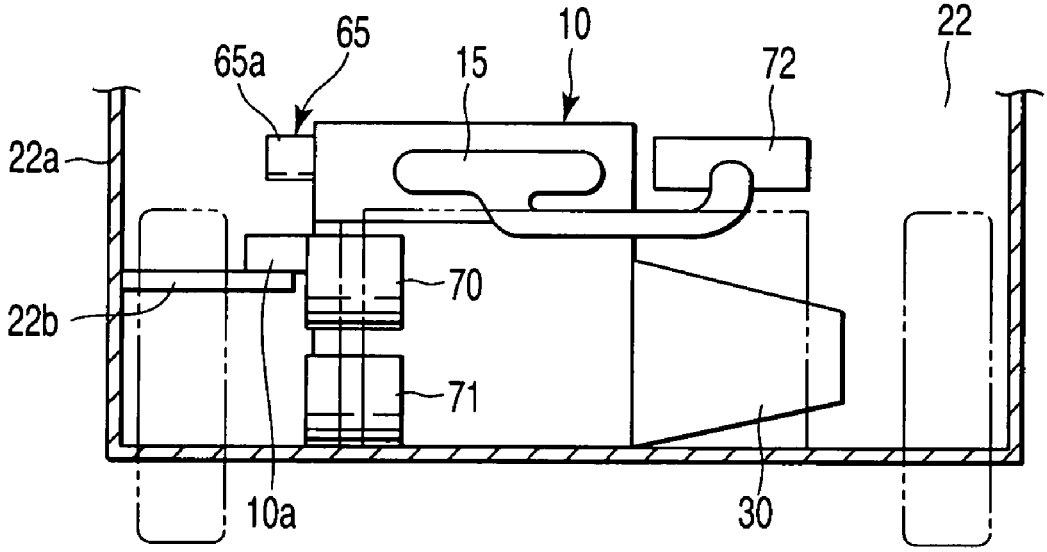
FIG. 9 is a front view schematically showing an interior of an engine room in which an engine provided with an arrangement structure of an electrically-driven actuator according to a third embodiment of the present invention is arranged as viewed from the front of the car body.

FIG. 9 is a front view schematically showing an interior of an engine room 22 in which an engine 10 of this embodiment is arranged as viewed from the front of the car body. As shown in FIG. 9, a fixing section 22*b* for fixing the engine 10 in the engine room 22 is provided on a vertical wall 22*a* on the right side in the car width direction of the engine room 22.

An engine bracket 10*a* used to fix the engine to the fixing section 22 is provided at a position at which, for example, the chain cover 14 faces the fixing section 22*b*, specifically, at a position on the wall part of the engine 10 facing the outside in the car width direction when the engine 10 is arranged in the engine room 22.

The electric motor 65 is protruded from a position which is on a cylinder head cover 13 above the engine bracket 10*a* and at which the motor 65 overlaps the engine bracket 10*a* in the vertical direction.

In this embodiment, the engine bracket 10*a* has a function of blocking heat 82 generated from a radiator core 40 and heat 80 generated from the engine 10, and hence the same advantage as in the first embodiment can be obtained. In addition, the engine 10 is prevented from becoming large in a direction intersecting the direction A in which cylinders 17 are arranged.

Next, an arrangement structure of an electrically-driven actuator according to a fourth embodiment of the present invention will be described below with reference to FIG. 10. Incidentally, a configuration having the same function as the first embodiment is denoted by the same reference symbols as those in the first embodiment and a description thereof is omitted.

This embodiment differs from the first embodiment in including a variable valve operating mechanism 202 in place of the variable valve operating mechanism 50. The other structures may be identical to those in the first embodiment. The above-mentioned different point will be specifically described below.

Figure 10:
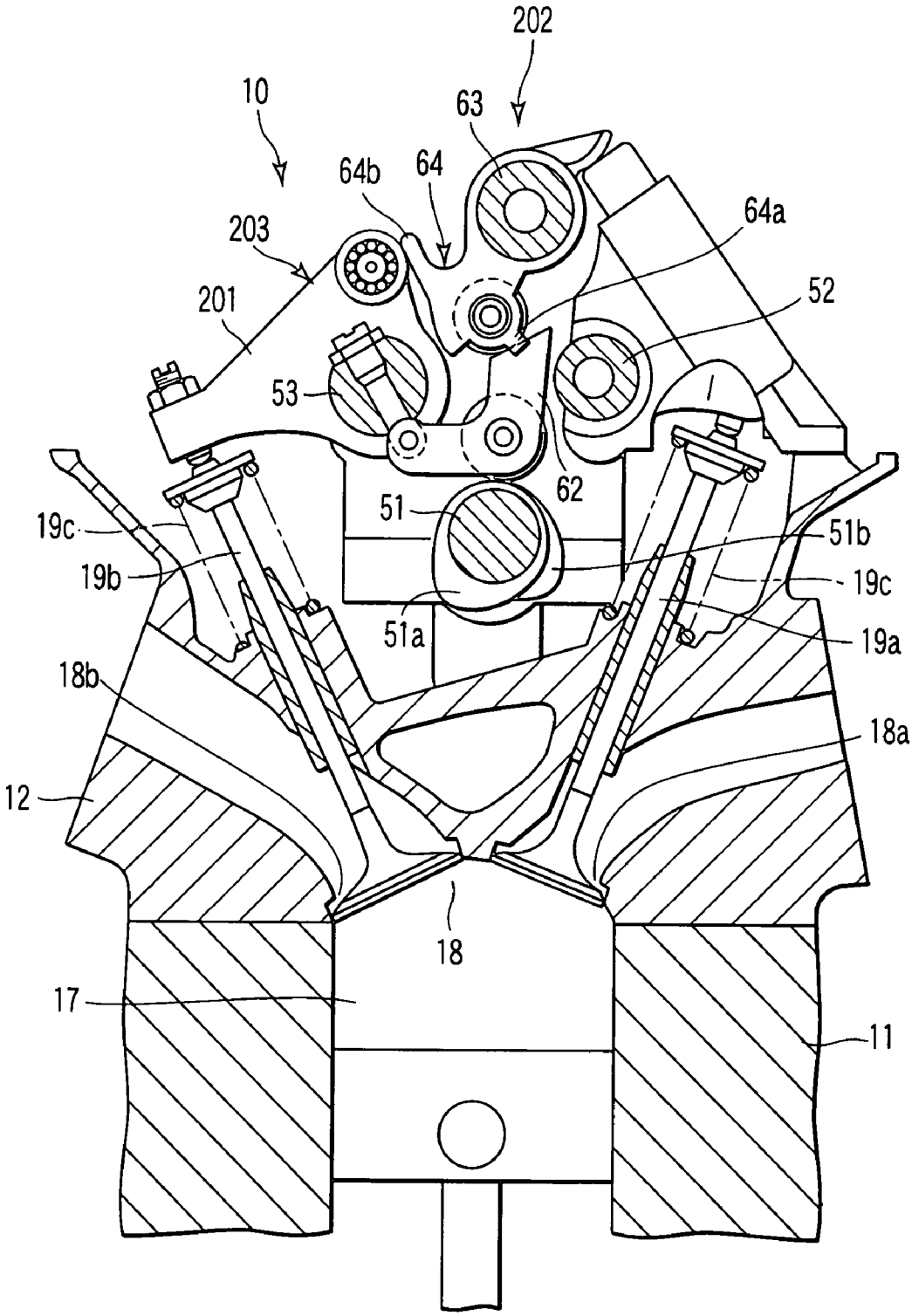
FIG. 10 is a cross-sectional view showing an engine provided with an arrangement structure of an electrically-driven actuator according to a fourth embodiment of the present invention.

FIG. 10 is a cross-sectional view showing an engine 10 of this embodiment. As shown in FIG. 10, in this embodiment, the variable valve operating mechanism 202 is provided in place of the variable valve operating mechanism 50. The variable valve operating mechanism 202 has a function of adjusting an opening/closing operation of an exhaust valve 19*b* and not that of an intake valve 19*a*.

The variable valve operating mechanism 202 has a structure in which the intake side and the exhaust side are replaced with each other in the structure of the variable valve operating mechanism 50 described in the first embodiment (accordingly, the configuration having the same function as the first embodiment is denoted by the same reference symbols).

In the variable valve operating mechanism 202, an intake valve rocker shaft 52 is supported so as not to be rotatable. An exhaust valve rocker shaft 53 is supported so as to be rotatable around the axis line.

An intake valve rocker arm (not shown) is attached to the intake rocker shaft 52. The intake valve rocker arm drives (opens/closes) an intake valve 19*a*. A structure for driving the intake valve 19*a* in this embodiment may be a mirror image structure of the structure for driving the exhaust valve 19*b* in the first embodiment. Accordingly, the intake valve rocker arm has a mirror image structure of the structure of the exhaust valve rocker arm 54.

The exhaust valve rocker shaft 53 is provided with a rocker arm mechanism 203. The rocker arm mechanism 203 can adjust an opening/closing operation of the exhaust valve 19*b*. The rocker arm mechanism 203 is provided with an exhaust valve rocker arm 201. Incidentally, the rocker arm mechanism 203 may have a mirror image structure of the structure of the rocker arm mechanism 60. Accordingly, the exhaust valve rocker arm 201 may have a mirror image structure of the structure of the intake valve rocker arm 61. In other words, the structure for driving the exhaust valve 19*b* in this embodiment may have a mirror image structure of the structure for driving the intake valve 19*a* in the first embodiment.

In this embodiment too, which has a structure in which the electric motor 65 is provided in the variable valve operating mechanism 202 for adjusting the opening/closing operation of the exhaust valve 19*b*, the same advantage as in the first embodiment can be obtained.

Next, an arrangement structure of an electrically-driven actuator according to a fifth embodiment of the present invention will be described below with reference to FIG. 11. Incidentally, a configuration having the same function as in the first and fourth embodiments is denoted by the same reference symbols as those in the first and fourth embodiments and a description thereof is omitted.

This embodiment differs from the first and fourth embodiments in the structure of the variable valve operating mechanisms 50, 202. The other structures may be identical to those of the first and fourth embodiments. The above-mentioned different point will be specifically described below.

Figure 11:
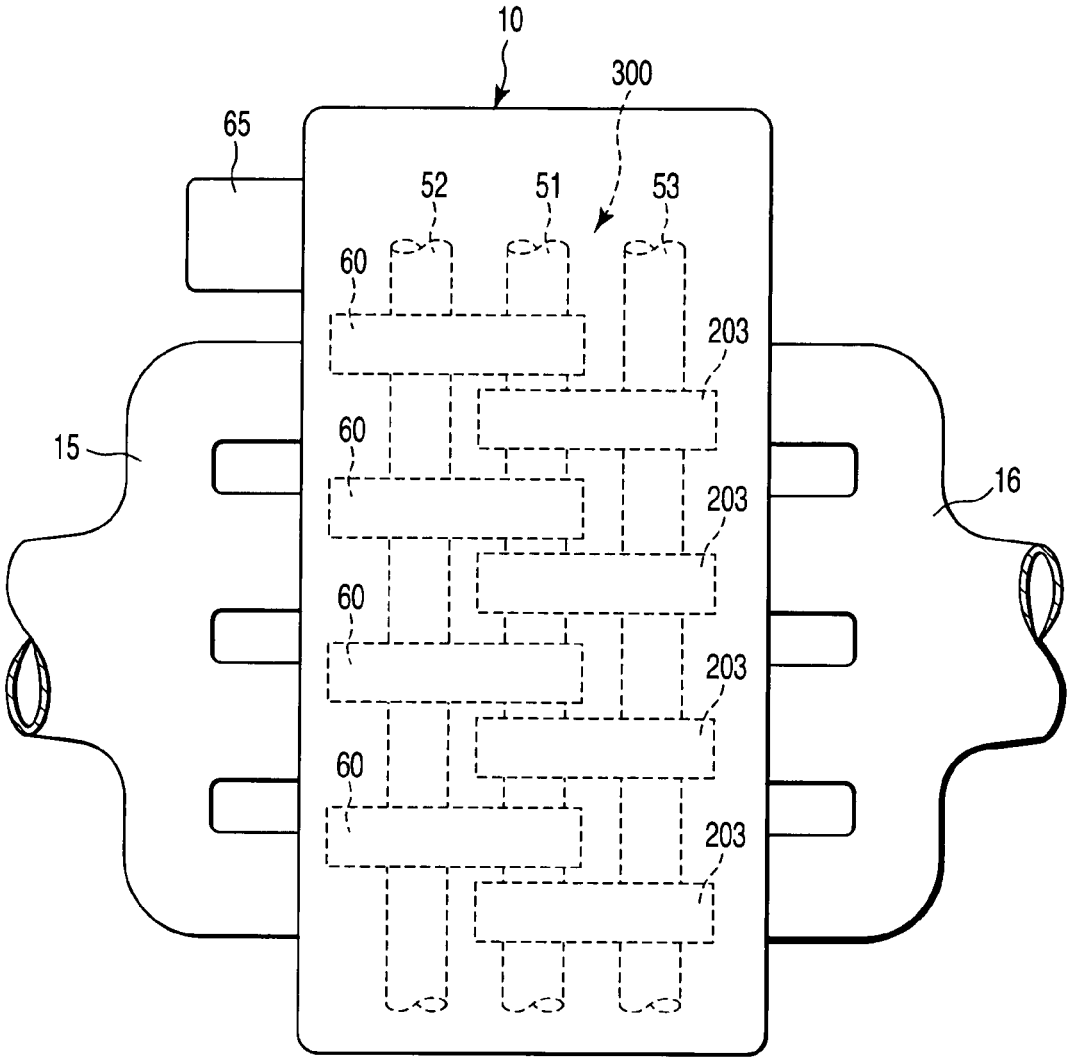
FIG. 11 is a plan view showing an engine provided with an arrangement structure of an electrically-driven actuator according to a fifth embodiment of the present invention.

FIG. 11 is a plan view showing an engine 10 of this embodiment. As shown in FIG. 11, in this embodiment, a variable valve operating mechanism 300 is provided in place of the variable valve operating mechanism 50 or variable valve operating mechanism 202. In the variable valve operating mechanism 300, a structure obtained by combining the structures described in the first and fourth embodiments is used. The variable valve operating mechanism 300 has the rocker arm mechanisms 60, 203. Incidentally, the variable valve operating mechanism 300 is indicated by dotted lines in FIG. 11.

More specifically, in the variable valve operating mechanism 300, an intake valve rocker shaft 52 and an exhaust valve rocker shaft 53 are rotatably supported around the axis line. Further, a rocker arm mechanism 60 described in the first embodiment is attached to the intake valve rocker shaft 52. A rocker arm mechanism 203 described in the fourth embodiment is attached to the exhaust valve rocker shaft 53.

In this embodiment, by virtue of the structure described above, it becomes possible to adjust opening/closing operations of an intake valve 19*a* and an exhaust valve 19*b*.

In this embodiment too, which has a structure in which the opening/closing operations of the intake valve 19*a* and the exhaust valve 19*b* are adjusted by the variable valve operating mechanism 300, the same advantage as in the first embodiment can be obtained.

As shown in FIG. 11, the electric motor 65 is located separate from the intake manifold 15 and the exhaust manifold 16 in the crankshaft axial direction (the direction A).

According to this configuration, the part of the electric motor 65 exposed to the outside of the engine 10 is hardly exposed to heat generated from the intake manifold 15 and the exhaust manifold 16. Moreover, the part of the electric motor 65 exposed to the outside of the engine 10 does not interfere with the intake manifold 15 or the exhaust manifold 16, and hence the maintenance such as replacement of the electric motor 65 is facilitated.

Figure 12:
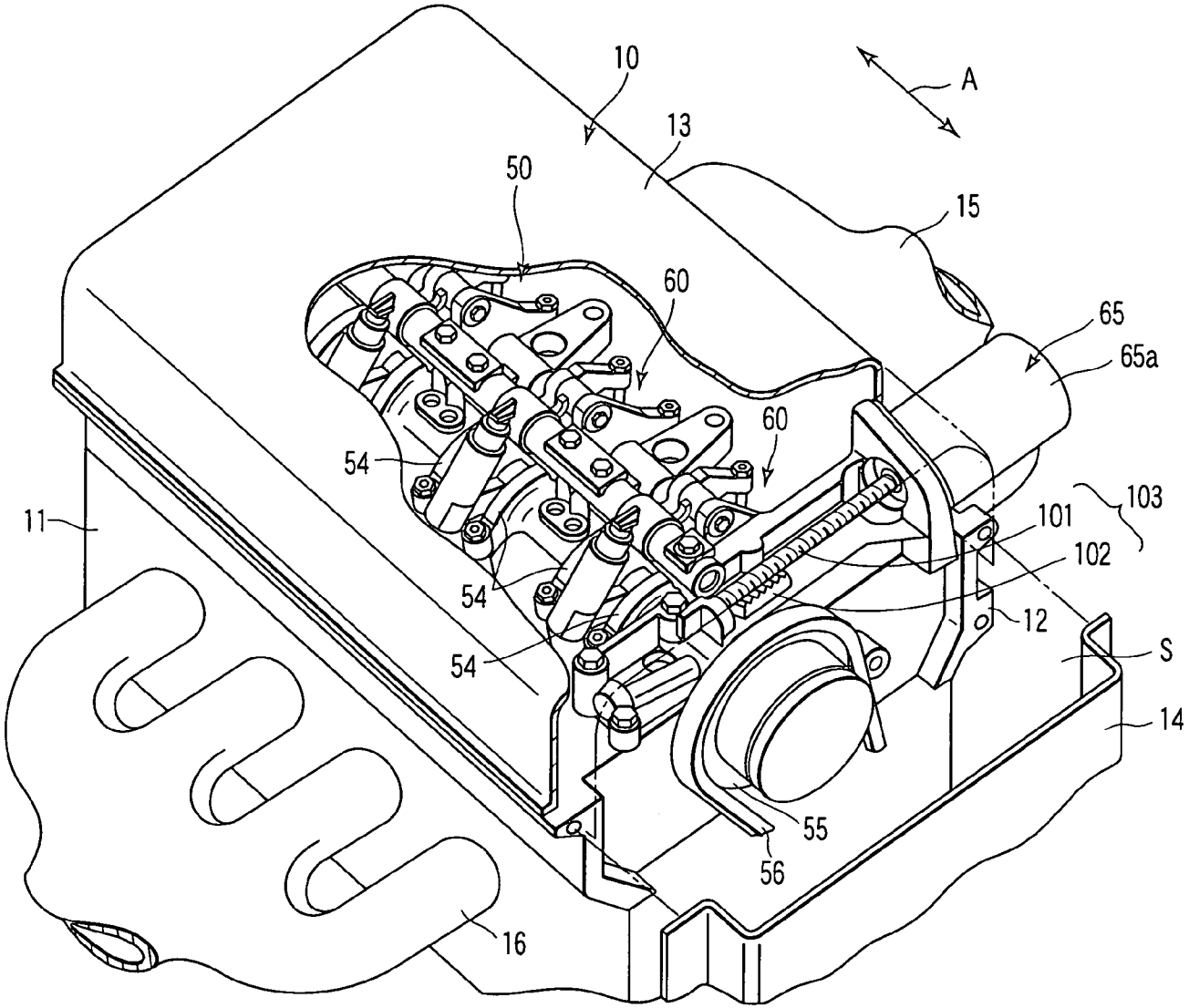
FIG. 12 is a perspective view showing an interior of an engine in a state where the actuator shown in FIG. 1 is totally out of a cylinder cover.

Incidentally, in the first to fifth embodiment described above, although a part of the electric motor of the actuator is arranged outside the cylinder head cover, as shown in FIG. 12 a structure in which an electric motor is arranged entirely outside a cylinder head cover can be applied to these embodiments. In this case, even if the entire electric motor is arranged outside the cylinder head cover, in accordance with the shape of the cylinder head cover or the layout, it is possible to make the electric motor be hardly exposed to heat.

Even if the variable valve operating mechanism 202,300, that is used in the fourth and fifth embodiments, is used in the second and third embodiments instead of the variable valve operating mechanism 50, the same advantages can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An arrangement structure of an electrically-driven actuator to be used in a variable valve operating mechanism capable of adjusting an operation of a valve of an engine, wherein the engine is provided with a transfer mechanism for transferring rotation of a crankshaft to a camshaft;

a part of the electrically-driven actuator exposed to the outside of the engine is arranged at a position shifted in a car width direction with respect to an exothermic body provided at a periphery of the engine;

at least a portion of the electrically-driven actuator is arranged in a space in which the transfer mechanism is accommodated in the engine; and a hood inclined to rise from a front side to a rear side of the car is arranged above the part.

2. The arrangement structure of an electrically-driven actuator according to claim 1, wherein the part of the electrically-driven actuator exposed to the outside of the engine is positioned on the opposite side of a transmission on the engine.

3. The arrangement structure of an electrically-driven actuator according to claim 1, wherein the part of the electrically-driven actuator exposed to the outside of the engine is arranged on a side surface of the engine at a position at which the actuator does not overlap the radiator core in a back-and-forth direction of a car body when the engine is arranged in an engine room.

4. The arrangement structure of an electrically-driven actuator according to claim 1, wherein the part of the electrically-driven actuator exposed to the outside of the engine is arranged at a position at which the part is above an engine auxiliary machinery and overlaps the engine auxiliary machinery, when the engine is arranged in an engine room.

5. The arrangement structure of an electrically-driven actuator according to claim 2, wherein the part of the electrically-driven actuator exposed to the outside of the engine is arranged at a position at which the part is above an engine auxiliary machinery and overlaps the engine auxiliary machinery, when the engine is arranged in an engine room.

6. The arrangement structure of an electrically-driven actuator according to claim 2, wherein the part of the electrically-driven actuator exposed to the outside of the engine is arranged at a position at which the part is above an engine bracket employed to attach the engine in an engine room and overlaps the engine bracket when the engine is arranged in the engine room.

7. The arrangement structure of an electrically-driven actuator according to claim 2, wherein the engine is provided with an intake manifold and an exhaust manifold, and the electrically-driven actuator is arranged separate from the intake manifold and the exhaust manifold in a crankshaft axial direction.

8. The arrangement structure of an electrically-driven actuator according to claim 3, wherein the part of the electrically-driven actuator exposed to the outside of the engine is arranged at a position at which the part is above an engine auxiliary machinery and overlaps the engine auxiliary machinery, when the engine is arranged in an engine room.

9. The arrangement structure of an electrically-driven actuator according to claim 3, wherein the part of the electrically-driven actuator exposed to the outside of the engine is arranged at a position at which the part is above an engine bracket employed to attach the engine in an engine room and overlaps the engine bracket when the engine is arranged in the engine room.

10. The arrangement structure of an electrically-driven actuator according to claim 3, wherein the engine is provided with an intake manifold and an exhaust manifold, and the electrically-driven actuator is arranged separate from the intake manifold and the exhaust manifold in a crankshaft axial direction.

11. The arrangement structure of an electrically-driven actuator according to claim 1, wherein the part of the electrically-driven actuator exposed to the outside of the engine is arranged at a position at which the part is above an engine bracket employed to attach the engine in an engine room and overlaps the engine bracket when the engine is arranged in the engine room.

12. The arrangement structure of an electrically-driven actuator according to claim 1, wherein the engine is provided with an intake manifold and an exhaust manifold, and the electrically-driven actuator is arranged separate from the intake manifold and the exhaust manifold in a crankshaft axial direction.

* * * * *

UNITED STATES PATENT AND TRADEMARK OFFICE

CERTIFICATE OF CORRECTION

PATENT NO. : 7,644,690 B2
APPLICATION NO. : 11/978571
DATED : January 12, 2010
INVENTOR(S) : Daisuke Yoshika et al.

It is certified that error appears in the above-identified patent and that said Letters Patent is hereby corrected as shown below:

Claim 1, Column 13, Line 5:

The line reading "exothermic body" should read --radiation core--.

Signed and Sealed this
Twenty-second Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,644,690 B2
APPLICATION NO. : 11/978571
DATED : January 12, 2010
INVENTOR(S) : Daisuke Yoshika et al.

It is certified that error appears in the above-identified patent and that said Letters Patent is hereby corrected as shown below:

Claim 1, Column 13, Line 5:

The line reading "exothermic body" should read --radiator core--.

This certificate supersedes the Certificate of Correction issued February 22, 2011.

Signed and Sealed this
Twenty-sixth Day of April, 2011

David J. Kappos

David J. Kappos
*Director of the United States Patent and Trademark Office*